US005761753A

United States Patent [19]

Talbert

[11] Patent Number: 5,761,753

[45] Date of Patent: Jun. 9, 1998

[54] BATHING CADDY

[76] Inventor: Frankie L. Talbert, 1701 Grant Rd., Lansdale, Pa. 19466

[21] Appl. No.: 825,832

[22] Filed: Apr. 4, 1997

Related U.S. Application Data

[63] Continuation-in-part of Ser. No. 516,928, Aug. 18, 1995, abandoned.

[51] Int. Cl.[6] ..... A47K 3/00

[52] U.S. Cl. ..... 4/559; 281/45

[58] Field of Search ..... 4/554, 559, 578.1, 4/579; 248/447, 447.1, 447.2; 281/44, 45

[56] References Cited

U.S. PATENT DOCUMENTS

| | | | |
|---|---|---|---|
| 2,302,806 | 11/1942 | Senter | 4/559 X |
| 3,123,935 | 3/1964 | Williams | 4/559 X |
| 3,861,384 | 1/1975 | Casternovia | 4/559 X |
| 3,950,793 | 4/1976 | Adams | 4/559 |
| 4,098,486 | 7/1978 | Hornsby | 4/559 X |
| 4,296,946 | 10/1981 | Larre et al. | 281/45 |
| 4,472,844 | 9/1984 | Mace | 4/579 |
| 5,174,607 | 12/1992 | Hill | 281/45 |
| 5,621,927 | 4/1997 | Reiss et al. | 4/559 |

*Primary Examiner*—Robert M. Fetsuga
*Attorney, Agent, or Firm*—Joseph W. Molasky and Associates

[57] ABSTRACT

A device for enabling a person while bathing to perform other activities including reading, writing, smoking and drinking. The device comprises: a main support bar having a telescoping support tube slidably and adjustably mounted therein, the main support bar being arranged to be pivotally mounted on a tub and the telescoping support tube being arranged to be releasably mounted on a tub; a clamping-bracket to pivotally mount one end of the main support bar onto a tub; a releasable mounting to releasably mount the telescoping support tube onto a tub; and a book holder supported by a support ledger onto the main support bar/telescoping support tube combination, the book holder having a pen/pencil holder built therein.

12 Claims, 5 Drawing Sheets

BATHING CADDY

This application is a Continuation-in-part of application Ser. No. 08/516,928 filed Aug. 18, 1995, now abandoned.

BACKGROUND OF THE INVENTION

We generally bathe daily, and some people spend a period of time bathing. And, while bathing, we tend to neglect other necessary activities such as reading, writing, drinking or smoking, and the like.

With the pace of living today, we generally feel that we cannot neglect to do necessary personal activities such bathing while we are tending to our business and social activities.

The present invention is intended to enable busy people to do a personal, necessary activity such as bathing while they are performing business activities, e.g., reading or writing and/or social activities, e.g., smoking or drinking.

Thus, there is a need for some means to enable persons to perform necessary personal activities such as bathing along with business activities such as writing and reading and/or social activities such as drinking and smoking.

SUMMARY OF THE INVENTION

This invention provides a device, a caddy, for enabling a person while bathing to perform other activities, e.g., to write, read (business activities) and/or to smoke, drink (social activities). This device comprises: a main support bar having a telescoping support tube slidably and adjustably mounted therein, the main support bar is arranged to be pivotally mounted onto a tub and the telescoping tube is arranged to be releasably mounted onto a tub. A clamping-bracket means is provided to mount one end of the main support bar onto a tub. Releasable mounting means are provided to releasably mount the exposed end of the telescoping support tube onto a tub. A book holder is mounted by a support ledger on the main support bar/telescoping support tube combination. The book holder includes a built-in pen/pencil holder that is arranged to have accessories attached thereto.

In an alternative embodiment, the book holder is mounted in a removable fashion and the support ledge is configured to be able to rotate forward into a horizontal position and may be used as a tray. The ledge/tray is formed to include one or more recessed areas, where these recesses function to hold typical bathing supplies, such as soap, shampoo, or the like. The book holder is configured so as to become a "free-standing" holder, suitable for use on a table, or the like, after removal from the support ledge.

BRIEF DESCRIPTION OF DRAWINGS

The present invention will be further understood when considering a detailed description along with the drawings, in which.

DETAILED DESCRIPTION OF THE PREFERRED EMBODIMENTS

Figure 1:
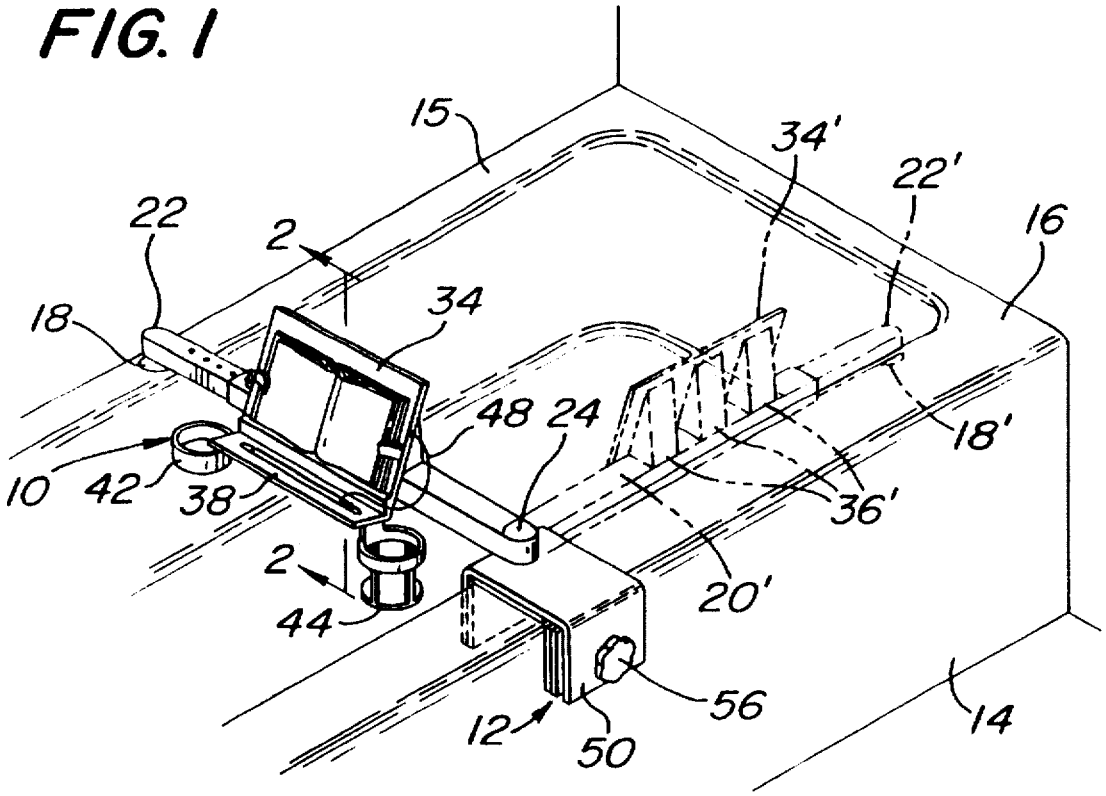
FIG. 1 illustrates both a perspective view of the present device mounted on a tub and a phantom view of the device in an alternate, pivoted position.

In the preferred embodiment illustrated in FIG. 1, the device for enabling a bather to perform other activities, is generally referred to by 10. The device 10, as shown, has a main support bar 20 which is mounted by a clamping-bracket means 12 to one ledge 16 of the tub 14 and a telescoping support tube 22 releasably mounted to the other ledge 15 of the tub 14, by releasable mounting means 18, i.e., a suction cup.

The device 10 is comprised of a main support bar 20 into which is slidably and adjustably mounted a telescoping support tube 22. The main support bar 20 at one end thereof, is pivotally mounted by a pivot 24 on the clamping-bracket means 12 which is secured on ledge 16 of the tub 14. The telescoping support tube 22 which is slidably and adjustably mounted within the main support bar 20 is releasably mounted at its exposed end by releasable means 18, i.e., the suction cup, onto ledge 15 of the tub 14. The telescoping support tube 22 and main support bar 20 have pin holes 30 through which an adjustment pin or screw 32 is placed to set the length of the main support bar/telescoping support tube combination to correspond to the width of the tub 14.

Figure 3:
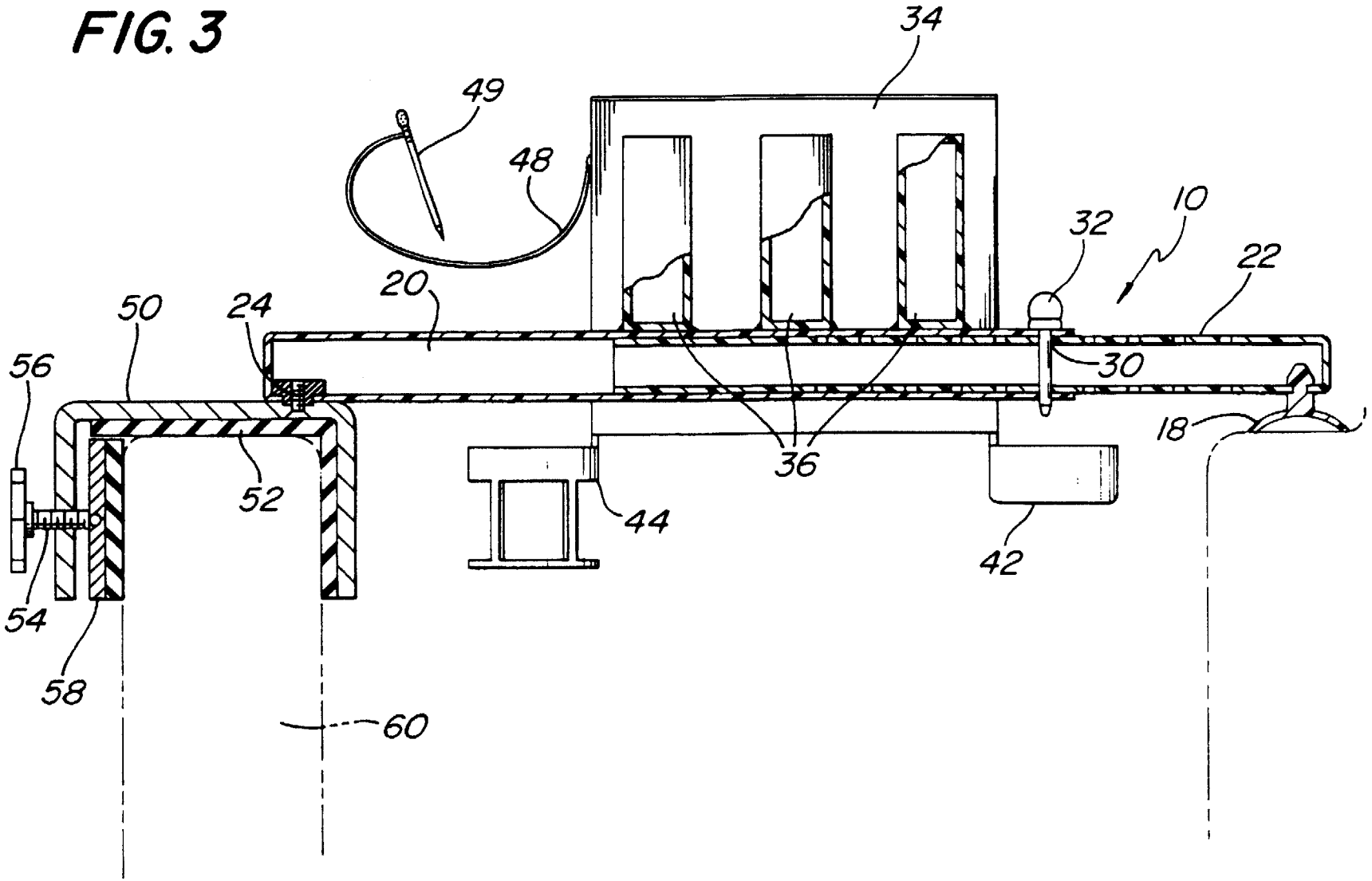
FIG. 3 is a partial sectional view of the device taken along line 3—3 of FIG. 2.

The clamping-bracket means 12 as shown specifically in FIG. 3 is comprised of an outer metal bracket 50 having an inner adjustable foam rubber padding 52 to protect the tub 14 from any marks or distortions. The foam rubber padding 52 may be adjusted by an adjustment screw 54 and knob 56 arrangement with a pressure plate 58 to the width of the wall 60 of the tub 14 to securely mount the main support arm 20 with the clamping-bracket means 12 onto the ledge 16 and to the wall 60 of the tub 14.

Also, referring to FIG. 3, the main support bar 20 is pivotally mounted by pivot 24 on the clamping-bracket means 12 while the telescoping support tube 22 is releasably mounted to the tub 14 by suction cup 18. The length of the main support bar 20 and telescoping tube 22 combination is set by an adjustment pin/screw 32 extending through pin holes 30 of both the main support bar 20 and telescoping support tube 22.

A book holder 34 is mounted by a support ledge 36 onto the main support bar/telescoping support tube combination. The ledge 36 may consist of one piece or three pieces as illustrated in FIG. 3. Built in the book holder 34 is a pen/pencil holder 38. Attached or mounted to the edges of the pen/pencil holder 38 may be personal/social accessories. As illustrated in FIG. 3, on the left edge 40 of the pen/pencil holder 38 is attached an ashtray 42 and on the right edge 41 is attached a cupholder 44.

On the edges of the book holder 34, metal spring clips 46 are provided to hold the pages and book without the use of any hands. A pen or pencil may be connected to the book holder 34 by a string or cable 48 or the like. The pen or pencil 49 may be used for writing or turning pages.

In the phantom view of FIG. 1, the device 10 is shown in an alternate or open position allowing the bather to enter or exit the tub 14. In this view, the support ledge 36' consisting of three pieces is shown supporting the book holder 34' on the main support arm 20'/telescoping support tube 22' combination. In the phantom view, the combination support 20'.22' is shown in a pivoted, alternate position on pivot 24 positioned in the clamping-bracket means 12.

The device, a caddy 10, as described above, enables a bather at the same time to easily perform personal, business, and social activities.

While the preferred embodiments have been fully described and depicted for the purposes of explaining the principles of the present invention, it will be appreciated by those skilled in the art that modification and changes may be made thereto without departing from the scope of the invention set forth in the appended claims.

Figure 2:
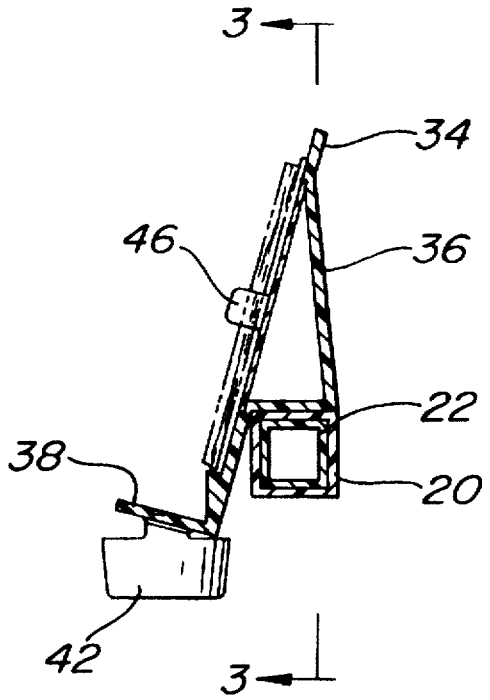
FIG. 2 is a partial sectional view of the device taken along line 2—2 of FIG. 1.
Figure 4:
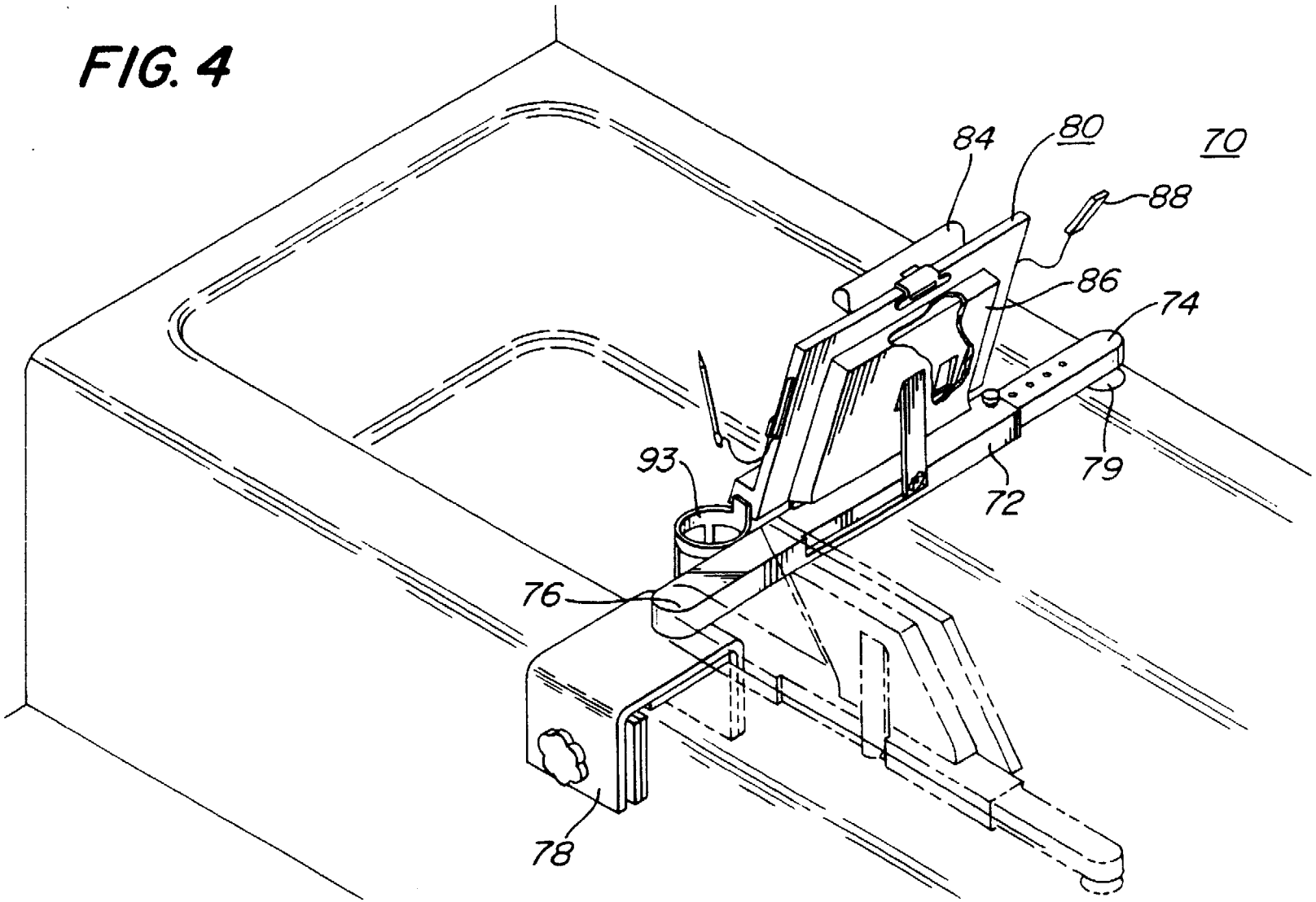
FIG. 4 illustrates a perspective rear view of an alternative embodiment of the present invention, including both a removable book holder and a rotatable book support ledge that may be used as a bath tray.

FIG. 4 illustrates an alternative embodiment of the present invention formed to include a removable book holder and a book ledge that may be reconfigured into a bath tray. As shown, device 70 includes a main support bar 72 into which is slidably and adjustably mounted a telescoping support tube 74. As with the embodiment described above, device 70 also includes a pivot 76 on a clamping-bracket means 78, where bracket 78 functions to releasably clamp device 70 onto the rim of a tub (shown in phantom). In general, the arrangement described thus far functions in a manner similar to that described above in association with FIGS. 1–3, that is, telescoping support tube 74 moves within main support tube 72 and may be releasably mounted onto a tub rim (shown in phantom) via suction cup 79.

Figure 5:
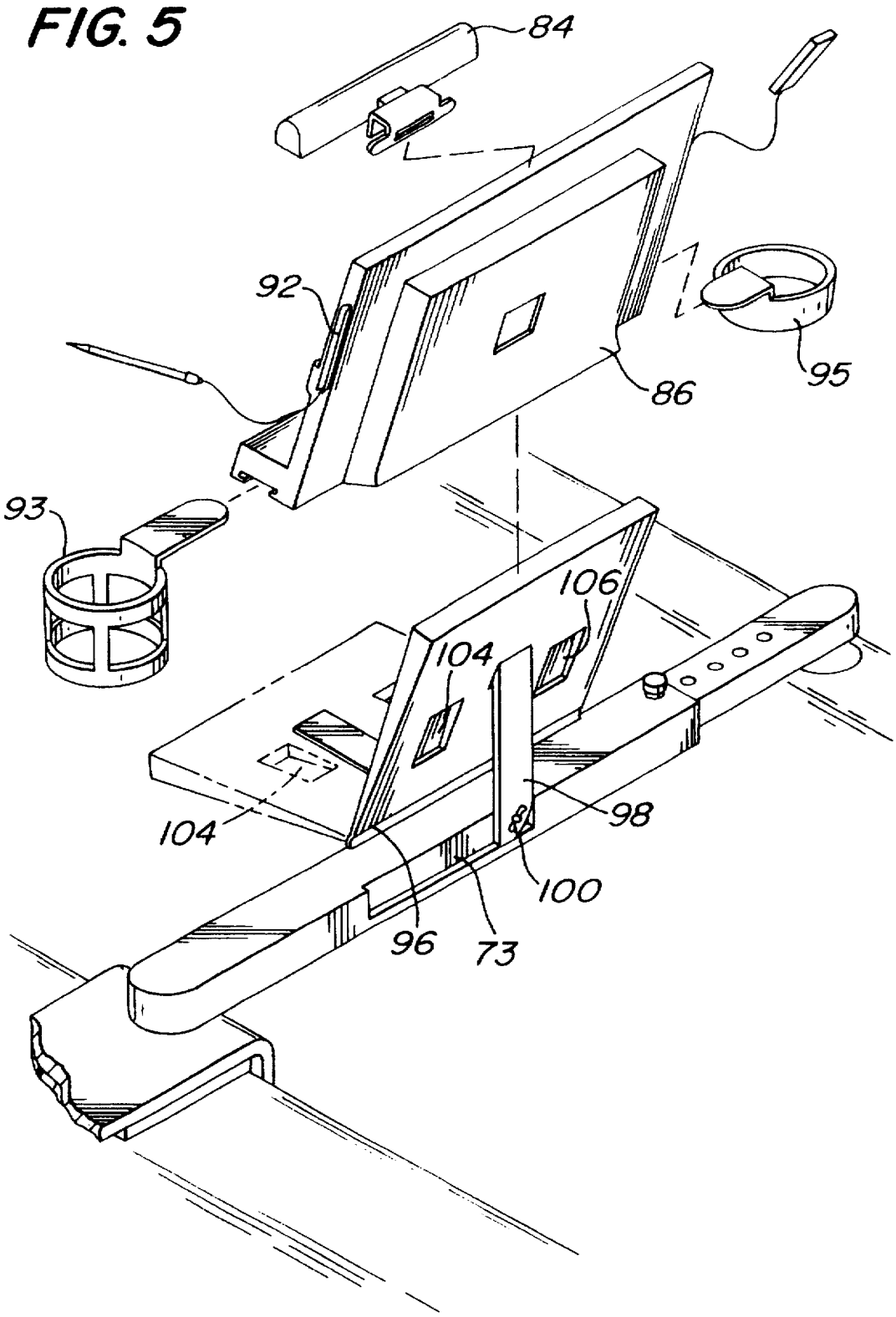
FIG. 5 is an exploded view of the arrangement of FIG. 4, illustrating in particular the ability to remove the book holder from the support ledge.
Figure 6:
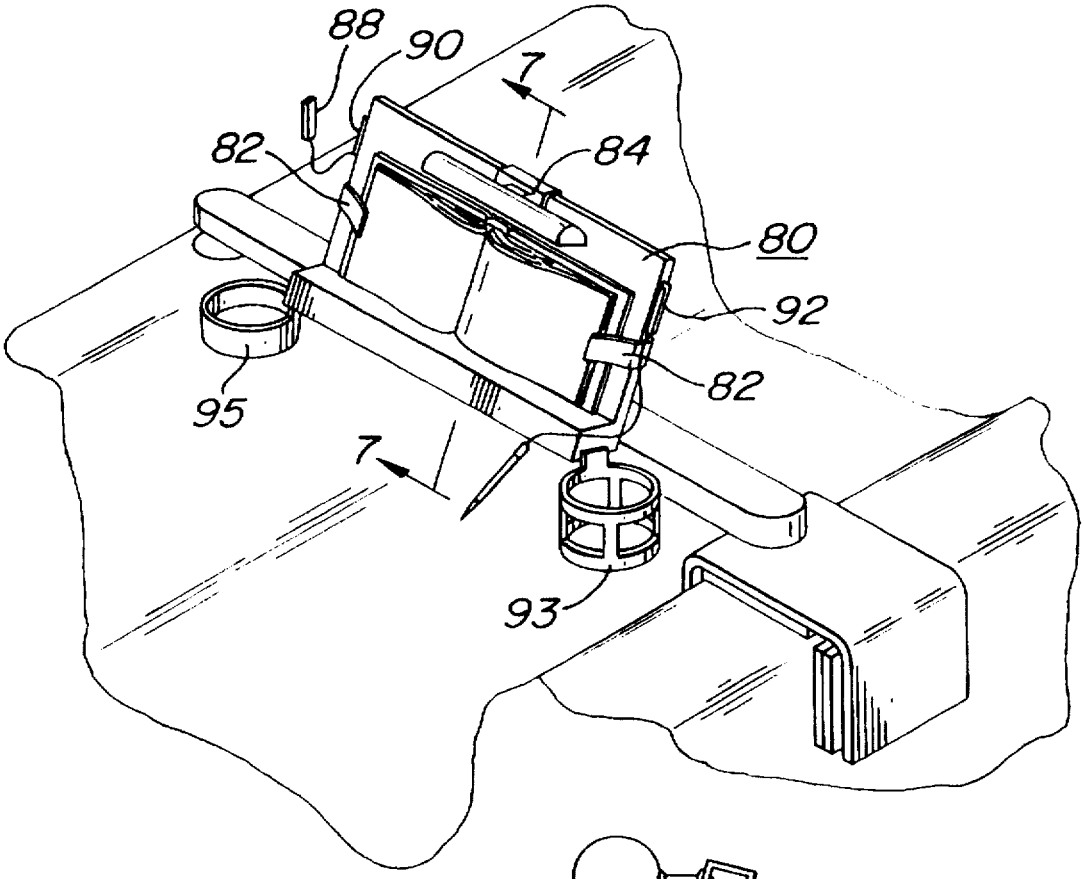
FIG. 6 contains a front view the of the alternative embodiment as illustrated in FIG. 4.

In the particular arrangement of this embodiment, a book holder 80 is removably attached to main support tube 72. As shown, book holder 80 is formed to include a rear pocket section 86, where pocket 86 is hollow and is formed to fit over and rest upon the support ledge 94. FIG. 5 illustrates clearly support ledge 94 and pocket 86, showing the capability to fit pocket 86 over ledge 94. Referring to both FIGS. 4 and 6, book holder 80 is illustrated as including a pair of tension adjustable book clamps 82, useful to hold open and secure the desired reading material—a book, magazine, or loose papers, for example. Advantageously, as illustrated in this particular embodiment, a reading lamp 84 may be attached to the top surface of book holder 80. Preferably, reading lamp 84 is a battery-operated lighting fixture. Other features that may be included with book holder 80 include a page turning device 88, of any suitable form, where device 88 is inserted in and attached to a holding clamp 90 when not in use. Additionally, a pen or pencil may be attached to book holder 80, and held in place when not in use via an additional holding clamp 92. As with the book holder arrangement discussed above in association with FIGS. 1–3, a drink holder 93 and ashtray 95 may also be built into book holder 80 of this embodiment.

It is a feature of this arrangement of the present invention that book holder 80 is removably mounted on support ledge 94. As shown in FIGS. 4 and 5, book holder 80 includes rear pocket portion 86 that is slipped over to rest upon support ledge 94. Therefore, when desired, book holder 80 may simply be removed by lifting it off of support ledge 94. Upon removal, book holder 80, by virtue of the design of rear pocket portion 86, may be used on a table (or the like) as a free-standing book rest. To be used as such, features such as drink holder 93 and ashtray 95 must be removed. Referring to FIG. 5, both holder 93 and ashtray 95 may be formed to slide into openings formed in holder 80 so that these items can easily be removed when using holder 80 as a free-standing book rest.

Figure 7:
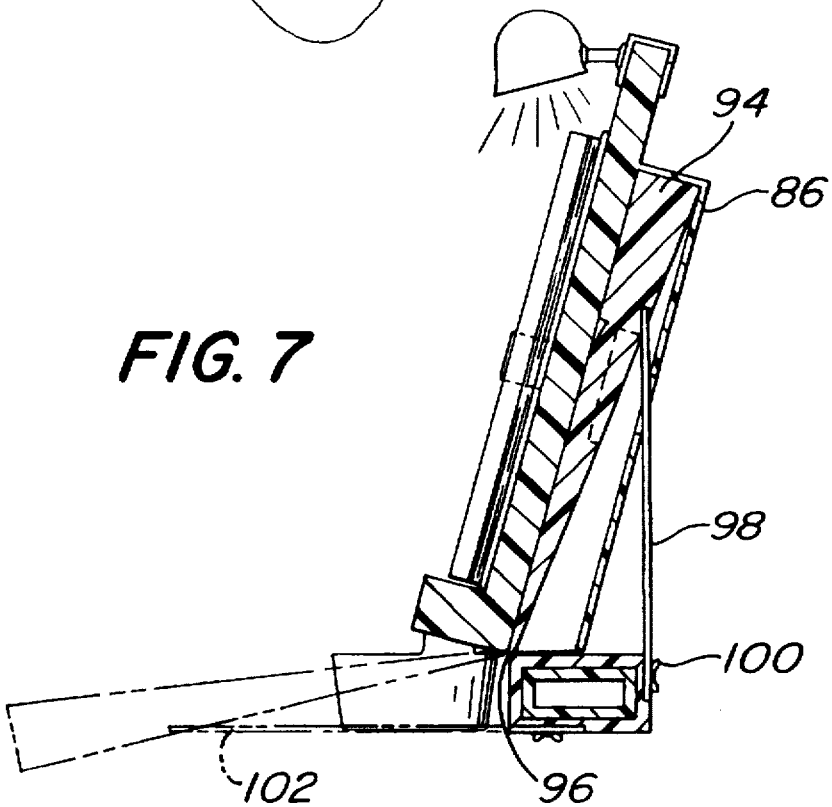
FIG. 7 is a cut-away side view of the alternative embodiment of the present invention, taken along line 7—7 of FIG. 6.

Once book holder 80 has been removed, support ledge 94 may be rotated into a horizontal position and function as a bath tray. In particular, as shown in FIGS. 5 and 7, book ledge 94 is attached to main support bar 72 along its bottom edge by a hinging member 96, and is held in its upright position by a support member 98, where support member 98 is connected to main support bar 72 by an adjustable screw member 100. Therefore, when it is desired to rotate ledge 94 into its "tray" position, screw member 100 is loosened, and support bar 72 is rotated into its stored position within main support bar 72. As shown in FIG. 5, support bar 72 may be formed to include a recess 73 so that support member 98 may fit within the overall dimensions of bar 72. The action of hinging member 96 allows for book ledge 94 to rotate forward. A tray support member 102 is utilized to maintain book ledge 94 in its tray position. In accordance with the teachings of the present invention, ledge/tray 94 is formed to include a number of recesses, where in FIGS. 5 a pair of recesses 104 and 106 are illustrated. These recesses are suitable for holding various bathing items, such as soap, shampoo, bath oil, or the like. In general, any desired number of recesses may be formed in ledge/tray 94 and used to hold any variety of items associated with bathing (e.g., bath toys for children, washcloth, etc.).

FIG. 7 illustrates, in phantom, a side view of the resulting "tray" configuration of this embodiment of the present invention, where tray support member 102 is shown in particular. When not required, tray support member may be released and rotated so as to store on the underside of main support bar 72.

Various other uses for a tray such as that formed by the rotatable structure of the present invention may be contemplated. For example, the tray may be used to hold a plate of food, or the like. These and other variations are considered to fall with the spirit and scope of the present invention.

What is claimed is:

1. A device for enabling a person while bathing in a tub to read, write, smoke, and other social and business activities, said device comprising:

(a) a main support bar including a first end and a second end, having a telescoping support tube slidably and adjustably mounted in said first end;

(b) clamping-bracket means to pivotally mount the second end of said main support bar onto said tub;

(c) releasable mounting means attached to an end of said telescoping support tube to releasably mount said support tube onto said tub;

(d) a book holder removably attached to said main support bar, said removable book holder capable of having a number of accessories attached thereto; and (e) a rotatable book ledge/tray member mounted to said main support bar in a manner whereby said rotatable book ledge may be held in a first, ledge position so as to support said removable book holder and may be held in a second, tray position when said book holder is removed.

2. A device as defined in claim 1 wherein the rotatable book ledge/tray includes at least one recess formed in a top surface, as viewed in the second, tray position, wherein the at least one recess can be used to hold a number of bathing items.

3. A device as defined in claim 1 wherein the removable book holder is formed to include a rear pocket section, said rear pocket section sized so as to fit over and be supported by the rotatable book ledge/tray when said ledge/tray is in its first, ledge position.

4. A device as defined in claim 3 wherein the rear pocket section of the removable book holder is configured to be used as a support for the book holder upon its removal from the rotatable book ledge/tray.

5. A device as defined claim 1 wherein the device further comprises (f) a ledge/tray vertical support member, attached at a first end to the main support bar, and at a second end to the rotatable book ledge/tray, said ledge tray vertical support member attached to said main support bar by a screw member, wherein said screw member is tightened to hold said rotatable book ledge/tray in the first, ledge position and said screw member is loosened to hold said rotatable book ledge/tray in the second, tray position.

6. A device as defined in claim 5 wherein the device further comprises (g) a ledge/tray horizontal support member, attached to said main support bar, for providing horizontal support to said rotatable ledge/tray in the second, tray position.

7. A device as defined in claim 1 wherein book clamping means are attaching to opposing sides of the book holder and function to hold reading material open and in place.

8. A device as defined in claim 1 wherein a reading lamp is attached to the top edge of the book holder.

9. A device as defined in claim 1 wherein the book holder further includes a page turning device held in place by a clamping means when not in use.

10. A device as defined in claim 1 wherein the clamping-bracket means is comprised of an outer metal bracket with an adjustable inner foam-rubber layer arranged to securely mount said main support bar onto said tub.

11. A device as defined in claim 1, wherein the releasable mounting means is a suction cup.

12. A device as defined in claim 1, wherein the main support bar is pivotally mounted onto said clamping-bracket means to pivot said device to an open position allowing the bather to enter or exit from said tub.

* * * * *